United States Patent [19]

Ausnit

[11] Patent Number: 4,736,451

[45] Date of Patent: Apr. 5, 1988

[54] EXTRUDED ZIPPER HAVING COMBINATION STABILIZING AND DIFFERENTIAL OPENING MEANS

[75] Inventor: Steven Ausnit, New York, N.Y.

[73] Assignee: Minigrip, Inc., Orangeburg, N.Y.

[21] Appl. No.: 944,961

[22] Filed: Dec. 22, 1986

[51] Int. Cl.[4] ..... B65D 33/16

[52] U.S. Cl. ..... 383/65; 24/587

[58] Field of Search ..... 383/63, 64, 65; 24/587; 156/66

[56] References Cited

U.S. PATENT DOCUMENTS

| | | | |
|---|---|---|---|
| 3,198,228 | 8/1965 | Naito | 24/587 |
| 3,338,284 | 8/1967 | Ausnit | 24/587 |
| 3,338,285 | 8/1967 | Jaster | 24/587 |
| 3,389,733 | 6/1968 | Siegel | 383/65 |
| 3,410,327 | 11/1968 | Ausnit | 24/587 |
| 3,416,585 | 12/1968 | Staller | 383/65 |
| 3,425,469 | 2/1969 | Ausnit | 24/587 |
| 3,633,642 | 1/1972 | Siegel | 383/64 |
| 4,101,355 | 7/1978 | Ausnit | 156/66 |
| 4,430,070 | 2/1984 | Ausnit | 493/215 |

FOREIGN PATENT DOCUMENTS

| | | | |
|---|---|---|---|
| 2129770 | 5/1984 | United Kingdom | 383/63 |

*Primary Examiner*—Stephen P. Garbe

*Attorney, Agent, or Firm*—Hill, Van Santen, Steadman & Simpson

[57] ABSTRACT

A bag closing separable fastener has a combination profile stabilizing and guiding and differential opening force enhancing post flange projecting from a base area along the outer side of a male profile and engagable with a base area alongside a complementary female profile. The post flange serves not only for stabilizing the male profile fastener strip, but also as a device for enhancing a hard-to-open from the inside and easy to open from the outside function of the fastener in respect to a bag with which associated. The male and female profile base areas and the post flange have substantially the same rigidity.

20 Claims, 1 Drawing Sheet

EXTRUDED ZIPPER HAVING COMBINATION STABILIZING AND DIFFERENTIAL OPENING MEANS

BACKGROUND OF THE INVENTION

The present invention relates in general to the reclosable bag art, wherein bags made from sheet material and more particularly plastic film are equipped with reclosable extruded zipper means wherein one bag wall has adjacent to the bag opening a zipper strip which has profile means interlockable with complementary profile means on the opposite bag wall. More particularly, the invention relates to the zipper means and new and improved profile structure therefor.

The present invention is particularly directed to extruded zippers of the kind wherein a single generally hook-shaped profile rib on one zipper strip is releasably interlockable within a single generally channel shaped or grooved complementary profile having confronting spaced generally hook-shaped lip means releasably interlockable with the hook-shaped rib profile. A prior art example of such zipper structure is seen in U.S. Pat. No. 4,101,355.

The foregoing zipper structure is distinguishable from zipper structures of the multi-hook and groove type as exemplified in U.S. Pat. No. 4,430,070, wherein both of the releasably interlockable profile strips have similar profile rib hooks and complementary grooves shaped for mating with the profile hooks of the companion strip.

A problem encountered with the single rib and groove profile zipper strips that is not encountered with the multicomplementary rib and groove zipper strip resides in that whereas the multi groove profile presents a fairly stable, generally square or rectangular shape resisting deformation in handling, the single hooked rib profile has heretofor generally lacked such stability, though some attempts have been made to correct this problem, as in copending application U.S. Ser. No. 866,917 filed May 27, 1986.

SUMMARY OF THE PRESENT INVENTION

An important object of the present invention is to provide a new and improved extruded zipper having stability in the rib profile zipper strip as well as in the complementary channel shaped profile strip.

Another object of the invention is to provide an extruded zipper, equipped with new and improved differential opening means.

Still another object of the invention is to provide an extruded zipper having new and improved combination stabilizing and differential opening means.

Yet another object of the invention is to provide a new and improved bag construction equipped with extruded zipper having combination stabilizing and differential opening means.

Pursuant to the present invention, there is provided a new and improved bag having opposite sheet material walls and providing a bottom end and a top end, the top end being defined by pull flanges having along their lower ends respective complementary reclosable separably interlockable extruded plastic fastener profiles, one of the profiles having a base which is substantially more rigid than said sheet material and attached to one of the walls, and having a male profile rib with an interlock hook projecting away from the pull flanges; a second of the profiles having a base which is substantially more rigid than said sheet material and attached to a second of the walls and having a groove shaped female profile structure interlockingly receptive of the male profile rib and formed with a hook complementary to the rib hook and arranged to be releasably interlocked with the rib hook. A combination profile stabilizing and guiding and differential opening force enhancing post flange projects from a first base area located alongside the male profile adjacent to the pull flanges, and in spaced parallel relation to the male profile in ample clearance relation to permit free reception of an arm of the female profile between said post flange and said rib for engaging said rib and thereby cooperating with the hooks in maintaining the fastener profiles separably interlocked. The post flange has a free edge adjacent to a second base area which is located alongside the female profile and is of sufficient regidity so that forces generated inside the bag and tending to separate the interlocked profiles will be resisted by said post flange thrusting as a stop at the free edge against the second area.

The invention also provides a new and improved bag closing separable fastener for attachment to mouth end portions of opposed sheet material bag walls having pull flanges defining an open end of the bag, and comprising: fastener strips providing respective separably interlockable male and female profiles; and a combination stabilizing and guiding and differential opening post flange alongside and in spaced relation to a side of the male profile arranged to be adjacent to bag flanges when attached to a bag wall, the relationship of the profiles being such that when closingly interlocked a free edge of the post flange is located adjacent to a strip area of sufficient rigidity alongside the female profile so that forces generated within an associated bag will be resisted by thrusting of the free edge with the strip area.

BRIEF DESCRIPTION OF THE DRAWINGS

Other objects, features and advantages of the present invention will be readily apparent from the following description of a representative embodiment thereof, taken in conjunction with the accompanying drawing, although variations and modification may be effected without departing from the spirit and scope of the novel concepts embodied in the disclosure, and in which.

DETAILED DESCRIPTION

Figure 1:
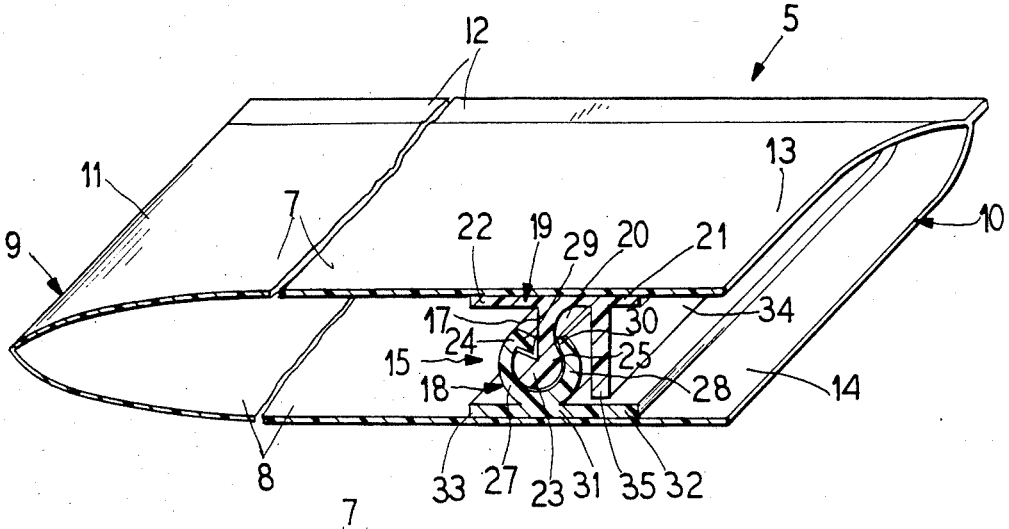
FIG. 1 is a fragmental sectional elevational view showing a bag equipped with the new and improved zipper construction according to the present invention.

Referring to FIG. 1, a bag 5 of generally conventional construction has opposed sheet material walls 7 and 8 desirably of plastic film, a bottom end 9, and a top end 10. The bottom end 9 may be closed by a fold 11. At opposite sides the bag may be closed in any preferred way, such as by means of heat seal seams 12, only one of which is shown, but it will be understood that the opposite side of the bag may be similarly sealed. At the top end 10 of the bag, the bag walls 7 and 8 define respective pull flanges 13 and 14 by which the bag is adapted to be pulled open, as demonstrated in FIG. 3.

At the inner or lower ends of the pull flanges 13 and 14, that is, spaced a limited distance inwardly or downwardly from the outer or upper edges of the pull flanges 13 and 14, the side walls 7 and 8 carry a reclosable zipper 15 which comprises extruded plastic reclosable fastener or zipper strips providing separably interlockable complementary extruded profiles 17 and 18 of the kind which are interengagable by pressing them toward one another, and which are separable by pulling them apart.

Herein the profile 17 has a base 19 suitably attached to the inner face of the bag wall 7. Desirably, the base 19 is in the form of a limited width fairly thick web or ribbon which is substantially more stiff, or more rigid, than the sheet material of the bag walls. The rib profile 17 has a body, leg, shank or stem 20 which extends integrally longitudinally from an intermediate area of the base 19, thereby providing a narrow base extension area lateral flange 21 extending outwardly or upwardly from the stem 20, and a similar base extension lateral flange 22 extending inwardly or downwardly from the stem 20.

At its distal or free edge, the stem 20 of the fastener rib 17 has a transversely rounded head 23 merging along an inner or downwardly facing side into a hook 24 providing a structure which is releasably interlockable with the groove profile member 18, as will be described. On its opposite, outer or upper, side the head 23 merges into a rounded shoulder or heel 25 which faces generally toward the pull flanges 13.

The structure of the profile 18 is complementary to the profile 17 in a manner to provide for an interlocked relationship which will strongly resist forces from within the bag tending to open the zipper 15, that is tending to separate the profiles 17 and 18, while permitting reasonably easy opening of the zipper from the outside of the bag by manipulation of the pull flanges 13 and 14. To this end, the profile 18 is of a generally semicircular channel or groove shape cross section complementary to the head 23 of the profile 17 and provided with generally arcuate, spaced walls or legs 27 and 28 which converge toward one another. Considered from the viewpoint of the pull flanges 13 and 14 being at the outer or upper end of the bag 5, the generally arcuately shaped leg 27 is located along the inwardly or downwardly facing side of the profile 18, and is of a geometric contour to receive the hook 24 within an out turned or upwardly directed complementary hook 29 along the free edge of the leg 27. It will be observed (FIG. 2) that the complementary interlocking hooks 24 and 29 are of such a length and oblique, biased or slanting relation toward the stem 20 of the profile 17 that there is a strong resistance to separation of the hooks from forces generated internally of the bag.

On the outer or upper side of the profile 18 the leg 28 provides an edge lip 30 turned generally toward the hooks 24 and 29 so as to engage retainingly with the heel 25. Thereby, the lip 30 in cooperation with the hook 29 maintains a satisfactory interlocked relationship of the profiles 17 and 18 for maintaining the bag closed under the normal circumstances for which the bag is intended. For enhancing the differential opening forces between the hooks 24 and 29 as compared to the heel 25 and the edge lip 30, the wall 27 is wider than the wall 28.

Attachment of the profile 18 to the bag wall 8 is by means of a base 31 in the form of a fairly thick web or ribbon providing an outwardly or upwardly extending lateral flange 32 of substantial rigidity similar to the lateral flange 21 of the profile 17, and an inwardly or downwardly extending lateral flange 33 generally the same as the lateral flange 22 of the profile 17. Any preferred mode of attachment of the base 31 to the wall 8, similarly as attachment of the base 19 to the wall 7 may be used, such as fusion or adhesive, both well known in this art.

Although the profile 18 provides a cross sectional shape which maintains substantial stability in handling of the profile 18, the stem 20 and head 23 of the profile 17 have a relatively slender profile shape in cross section, and thus lack the handling stability experienced with the profile 18. According to the present invention, therefore, the profile 17 is provided with stabilizing means which, in effect, will provide a stabilizing cross sectional shape for the profile 17. To this end, a preferably longitudinally continuous stabilizing post flange 34 is provided integral with and projecting generally right angularly from the lateral flange portion or area 21 of the base 19 of the profile 17. A sufficient parallel spaced relation is maintained between the flange 34 and the profile 17 to provide for easy movement of the lip leg 28 of the profile 18 into and out of position relative to the profile 17. Nevertheless, the distance between the post flange 34 and of the profile 17 is such that the post flange 34 will assist in guiding the profiles into the interlocked relationship when closing the zipper 15. For maximum efficiency, the width of the post flange 34 from its connection with the base flange 21 to its free edge 35 should be at least as great as the overall width of the stem 20 and head 23 of the profile 17 so as to cooperate effectively for stability in handling of this profile strip.

Initially it was proposed to have the post flange 34 extend from the base flange 22 at the inner or lower side of the profile 17. However, it was found that this orientation of the post flange 34 virtually defeated the easy opening of the bag from the outside, because the bag opened with greater difficulty from the outside than from the inside, especially when the zipper 15 was attached to thin film bag walls. On investigation, it was found that when it was attempted to open the bag by pulling the pull flanges 13 and 14 apart, the free edge of the post flange 34 thrust against the inner or lower base flange 33 of the profile 18, thus tending to block opening of the bag.

Figure 2:
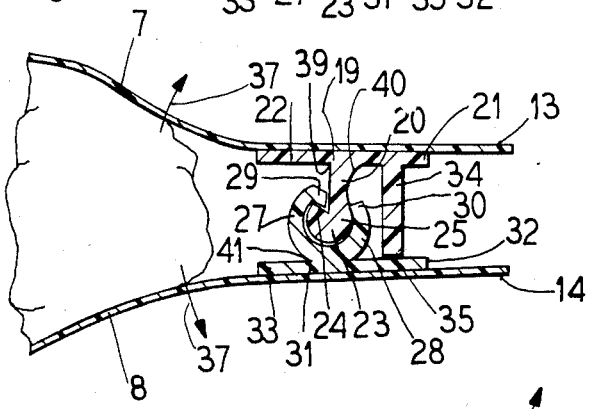
FIG. 2 is a fragmentary sectional detail view of the open or top end of the bag demonstrating how the new and improved zipper resists opening by virtue of the combination stabilizing and differential opening means of the present invention.
Figure 3:
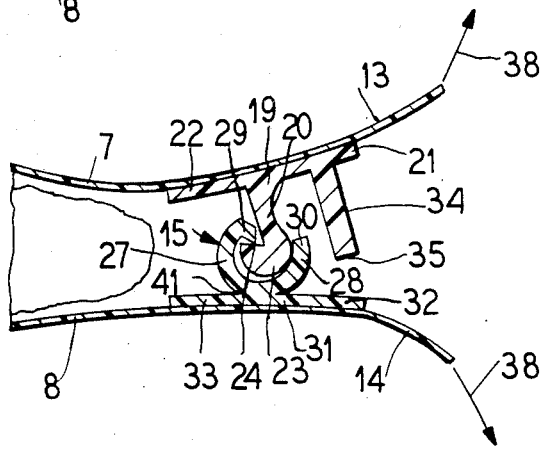
FIG. 3 is a view similar to FIG. 2, demonstrating the relative ease with which the new and improved zipper can be opened from the top or outside of the bag when desired.

Upon reversing the position of the post flange 34 to that shown in FIGS. 1–3, namely to project from the area of the outer or upper base flange 21 toward engagement with the area of the outer or upper base flange 32 of the profile 18, a very beneficial result was discovered. Not only does the post flange 34 in the outer or upper orientation provide good stabilization for the zipper profile 17, but it increases the force differential with respect to the opening of the bag from the inside versus opening from the outside. That is, forces from the inside of the bag tending to spread the bag walls 7 and 8 apart as indicated by the arrows 37 in FIG. 2, are substantially resisted, supplemental to the resistance to opening of the zipper provided by the interhooked relation of the hooks 24 and 29. Thus the post flange 34 serves as a stop against outward tilting of the profiles 17 and 18 and at the same time substantially reinforces the force needed to open the bag from the inside. Nevertheless, when the pull flanges 13 and 14 are pulled apart as indicated by the arrows 38 in FIG. 3, the zipper 15 is relatively easily opened because the stabilizing post flange 34 is tilted away from the base wing flange 32, as shown.

While dimensions of the various elements of the structure may vary depending upon bag size and use requirements, where the walls 7 and 8 of the bag 5 are formed from plastic sheet or film material of two mils thickness or less, the base flange structures 19 and 31, as well as the thickness of the post flange 34 may desirably be no less than about fifteen mils. This provides adequate stiffness or rigidity in the profile structures. Although the edge tip 35 of the post flange 34 may touch the base flange 32 or may be only slightly spaced from the flange 32, any spacing should be close enough so that when internal forces develop within the bag, the tip 35 will effectively thrust in the nature of a stop post against the base flange 32.

The hard opening inside, easy opening outside relationship is enhanced by having juncture of the profile stem 20 with the base flange 22 at a fairly abrupt reentrant corner 39 so that when the forces 37 are especially severe, the flange 22 may yield bendably relative to the stem 20. On the other hand, juncture of the profile stem 20 with the base flange 21 is desirably on a fillet 40 which relatively stiffens this juncture so that when the bag opening force 38 is applied, such opening force will be efficiently transmitted to the profile 17 and more particularly the stem 20 and the hooked head 23 for separating the profile 17 from the profile 18.

The differential opening is further improved by juncture of the profile leg 27 with the base flange 33 being on a fairly sharply reentrant corner 41 so that the internal forces 37 may cause the base flange 33 to bend away from the profile leg 27 whereby to relieve separating stresses from the interlocked hooks 24 and 29. Further, the profile leg 27 is preferably wider than the opposite profile leg 28.

It will be understood that variations and modifications may be effected without departing from the spirit and scope of the novel concepts of the present invention.

I claim as my invention:

1. A bag having opposite sheet material walls and providing a bottom end and a top end, said top end being defined by pull flanges having along their lower ends respective complementary reclosable separably interlockable extruded plastic fastener profiles:

one of said profiles having a base which is substantially more rigid than said sheet material and attached to one of said walls, and having a male profile rib with an interlock hook projecting away from said pull flanges;

a second of said profiles having a base which is substantially more rigid than said sheet material attached to a second of said walls and having a groove shaped female profile structure interlockingly receptive of said male profile rib and formed with a hook complementary to said rib hook and arranged to be releasably interlocked with said rib hook;

a combination profile stabilizing and guiding and differential opening force enhancing post flange projecting from a first profile base area located alongside one said profile adjacent to said pull flanges, and being in spaced parallel relation to said male profile in ample clearance relation to permit free reception of an arm of said female profile between said post flange and said profile rib for engaging said rib and thereby cooperating with said hooks in maintaining the fastener profiles separably interlocked; and said post flange having a free edge adjacent to a second profile base area which is located alongside a second said profile and is of sufficient rigidity, so that forces generated inside the bag and tending to separate the interlocked profiles will be resisted by said post flange thrusting as a stop at said free edge against said second profile base area.

2. A bag according to claim 1, wherein said male profile rib has a head from which said interlock hook projects, and a heel projecting from the opposite side of said head and generally toward said pull flanges, and said arm of said female profile having a lip and engaging retainingly with said heel when said hooks are releasably interlocked, said heel and arm being substantially more easily separable than said hooks.

3. A bag according to claim 2, wherein said female profile has the complementary hook thereof on an arm which is wider than said arm having said lip whereby to enhance differential opening forces.

4. A bag according to claim 1, wherein said first base area is alongside said male profile and said male profile has a structure which cooperates with said post flange for enhancing resistance to separation of the interlocked profiles by said forces generated inside the bag.

5. A bag according to claim 1, wherein said male profile base including said first profile base area comprises a ribbon-like structure having a thickness substantially the same as the thickness of said post flange.

6. A bag according to claim 1, wherein said post flange and said second profile base area are of a minimum fifteen mil thickness.

7. A bag according to claim 1, wherein said post flange and said second profile base area are of substantially the same rigidity.

8. A bag according to claim 1, wherein said post flange is of a width substantially the same as the width of said male profile rib.

9. A bag closing separable fastener for attachment to mouth end portions of opposed sheet material bag walls having pull flanges defining an open end of the bag, and comprising:

fastener strips providing respective separably interlockable male and female profiles; and a combination stabilizing and guiding and differential opening post flange alongside and in spaced relation to a side of one said profile and arranged to be adjacent to bag pull flanges when attached to a bag wall, the relationship of said profiles being such that when closingly interlocked a free edge of said post flange is located adjacent to a strip area of a second said profile and of sufficient rigidity so that profile separating forces applied to said fastener strips from the side opposite to said post flange will be resisted by thrusting of said free edge against said strip area.

10. A bag closing separable fastener according to claim 9, wherein said area comprises an extension from a thickened base of said female profile.

11. A bag closing separable fastener according to claim 10, wherein said area and said post flange are of a minimum fifteen mil thickness.

12. A bag closing separable fastener according to claim 9, wherein said strip area and said post flange are of substantially the same rigidity.

13. A bag closing separable fastener according to claim 9, wherein the width of said post flange is substantially the same width as said male profile.

14. A bag closing separable fastener according to claim 9, wherein said post flange extends integrally from a flange extension of a base of said male profile.

15. A bag closing separable fastener according to claim 9, wherein said male and female profiles have respective ribbon-like bases for attachment to bag walls, said female profile providing a shape in cross section for facilitating handling of the female profile before attachment to a bag wall, and said male profile having a generally ribbon-like base for attachment to a bag wall and said post flange carried by said male profile and cooperating with said male profile so as to provide a shape for facilitating handling of the male profile strip before attachment to a bag wall.

16. A bag closing separable fastener according to claim 9, wherein said fastener strips have generally ribbon-like base structures from which said profiles project, said post flange projecting from the base structure of the male profile strip, and said strip area comprising a part of the base structure of the female fastener strip.

17. A bag closing separable fastener for attachment to mouth end portions of opposed sheet material bag walls having pull flanges defining an open end of the bag, and comprising:

one of said profiles having a rib provided with a hook projecting from one side of the rib and a heel projecting from the opposite side of said rib;

a generally groove shaped profile complementary to said rib profile and having spaced generally convergent arms, one of said arms having a hook interlockably engagable with said hook of said rib profile and the other of said arms having a turned edge lip interlockably engagable with said heel;

both of said profiles having respective ribbon-like bases with flange extensions of said bases extending from said opposite saide; and a post flange projecting from one of said base flange extensions and spaced from the side of said rib which has said heel, said post flange having a tip engagable with a second of said base flange extensions for resisting separation of said profiles when profile separating force is applied to said strips at said one side.

18. A bag closing separable fastener according to claim 17, wherein said post flange and said base flange extension engagable by said post flange tip are both of a minimum fifteen mil thickness.

19. A bag closing separable fastener according to claim 17, wherein said post flange and said base flange extension engagable by said post flange tip are of substantially the same rigidity.

20. A bag closing separable fastener according to claim 17, wherein said post flange and said profile rib are of substantially the same length.

* * * * *